US008585562B2

(12) United States Patent
Chen

(10) Patent No.: US 8,585,562 B2
(45) Date of Patent: Nov. 19, 2013

(54) SKIING SIMULATING EXERCISE MACHINE

(76) Inventor: Paul Chen, Richmond (CA)

( * ) Notice: Subject to any disclaimer, the term of this patent is extended or adjusted under 35 U.S.C. 154(b) by 195 days.

(21) Appl. No.: 13/317,181

(22) Filed: Oct. 12, 2011

(65) Prior Publication Data

US 2013/0095982 A1 Apr. 18, 2013

(51) Int. Cl.
*A63B 21/00* (2006.01)

(52) U.S. Cl.
USPC ..... 482/71; 482/111

(58) Field of Classification Search
USPC ..... 482/70, 71, 72, 111, 112
See application file for complete search history.

(56) References Cited

U.S. PATENT DOCUMENTS 4,529,194 A 7/1985 Haaheim
4,826,152 A 5/1989 Lo
5,074,550 A * 12/1991 Sloan ..... 482/29
5,342,264 A 8/1994 Gordon
5,368,533 A 11/1994 Feuer et al.
5,501,646 A * 3/1996 Miller ..... 482/11
5,665,033 A 9/1997 Palmer
7,014,595 B2 3/2006 Bruno

* cited by examiner

*Primary Examiner* — Jerome W Donnelly
(74) *Attorney, Agent, or Firm* — Charles E. Baxley

(57) ABSTRACT

A skiing simulating exercise machine includes a supporting base for supporting a user, a pair of retractable couplers attached to the supporting base, and a pair of handle devices coupled to the retractable couplers for being grasped by the user and for simulating a skiing operation. The supporting base includes a beam for attaching the retractable couplers, the retractable couplers each include a rod slidably engaged in a housing, and a spring biasing member coupled between the rod and the housing for retracting the rod into the housing. The retractable couplers each include a wheel attached to the rod for allowing the rod to be smoothly moved into and out of the housing.

18 Claims, 8 Drawing Sheets

SKIING SIMULATING EXERCISE MACHINE

BACKGROUND OF THE INVENTION

1. Field of the Invention

The present invention relates to a skiing simulating and rehabilitation exercise machine, and more particularly to a skiing simulating and rehabilitation exercise machine including an improved structure for suitably simulating the skiing operations or exercises and for reducing the manufacturing procedures and the manufacturing cost for the skiing simulating and rehabilitation exercise machine.

2. Description of the Prior Art

Typical skiing simulating and rehabilitation exercise machines comprise a pair of handles supported on top of a base support, a pair of channels or tracks or rails supported on the lower portion of the base support, and a pair of foot supports or foot pedals slidably engaged with the tracks or rails for being actuated or operated by the user to slide along the tracks or rails and to simulate the skiing operations or exercises.

For example, U.S. Pat. No. 4,529,194 to Haaheim, and U.S. Pat. No. 5,368,533 to Feuer et al. disclose two of the typical skiing simulating and rehabilitation exercise machines comprising a pair of foot supports or foot pedals slidably engaged with the tracks or rails for being actuated or operated by the user to slide along the tracks or rails, and a pair of hand grips also slidably engaged with the other tracks or rails for being actuated or operated by the user to slide along the other tracks or rails and to simulate the skiing operations or exercises.

However, the foot supports or foot pedals and the hand grips may only be moved forwardly and backwardly along the tracks or rails, but may not be moved up and down relative to the tracks or rails and the lower base support. However, in the actual skiing operations or exercises, the foot supports or foot pedals and/or the hand grips may move up and down along or relative to the uneven or convex or concave ground.

U.S. Pat. No. 4,826,152 to Lo discloses another typical skiing simulating and rehabilitation exercise machine comprising a pair of foot supports or foot pedals slidably engaged with the tracks or rails for being actuated or operated by the user to slide along the tracks or rails, and a pair of hand grips pivotally attached or mounted or secured or coupled to the lower base support or the tracks or rails, and to actuate or simulate the skiing operations or exercises.

However, the sliding engagement of the foot supports or foot pedals with the tracks or rails may include a complicated structure that may not be easily and quickly manufactured and assembled by the workers. In addition, the foot supports or foot pedals are slidably engaged with the tracks or rails, but may not be moved up and down relative to the tracks or rails and the lower base support, and the hand grips may only be moved or pivoted forwardly and backwardly, but may not be moved up and down relative to the tracks or rails and the lower base support.

U.S. Pat. No. 5,342,264 to Gordon, and U.S. Pat. No. 7,014,595 to Bruno disclose two further typical skiing simulating and rehabilitation exercise machines each comprising a pair of foot supports or foot pedals slidably engaged with the tracks or rails for being actuated or operated by the user to slide along the tracks or rails, and one or more hand grips attached or mounted or secured to the lower base support or the tracks or rails, and to simulate the skiing operations or exercises.

However, the foot supports or foot pedals are slidably engaged with the tracks or rails, but may not be moved up and down relative to the tracks or rails and the lower base support, and the hand grips may not be moved or pivoted forwardly and backwardly, and also may not be moved up and down relative to the tracks or rails and the lower base support.

U.S. Pat. No. 5,665,033 to Palmer discloses a still further typical skiing simulating and rehabilitation exercise machine comprising a pair of foot supports or foot pedals to be actuated or operated or stepped up and down by the user to simulate the skiing operations or exercises.

However, the attachment or the engagement of the foot supports or foot pedals with the lower base support also may include a complicated structure that may not be easily and quickly manufactured and assembled by the workers.

The present invention has arisen to mitigate and/or obviate the afore-described disadvantages of the conventional skiing simulating and rehabilitation exercise machines.

SUMMARY OF THE INVENTION

The primary objective of the present invention is to provide a skiing simulating and rehabilitation exercise machine including an improved structure for suitably simulating the skiing operations or exercises and for reducing the manufacturing procedures and the manufacturing cost for the skiing simulating and rehabilitation exercise machine.

In accordance with one aspect of the invention, there is provided a skiing simulating exercise machine comprising a supporting base, a pair of retractable couplers attached to the supporting base, and a pair of handle devices coupled to the retractable couplers for being grasped by the user and for allowing the retractable couplers to be selectively retracted or extended and for simulating a skiing operation.

The supporting base includes a beam for attaching the retractable couplers. The retractable couplers each include an outer housing, and a rod slidably received and engaged in the housing. The retractable couplers each include a spring biasing member coupled between the rod and the housing for selectively retracting the rod into the housing.

The retractable couplers each include a wheel attached to the rod for allowing the rod to be smoothly moved into and out of the housing. The handle devices each include an extension pivotally coupled to the rod with a pivot axle, and a hand grip slidably attached onto the extension.

The handle devices each include a spring biasing member coupled between the hand grip and the extension for selectively biasing the extension out of the hand grip and for forming a retractable or telescopic structure.

A foot support may further be provided and disposed on the supporting base for supporting a user thereon. The supporting base includes a cushioning member disposed on the base support, and a platform mounted on the cushioning member for supporting the user thereon.

The cushioning member includes a chamber formed therein for forming a tubular element and for increasing a resilience of the cushioning member. The cushioning member includes an outer peripheral recess formed therein for increasing a resilience of the cushioning member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
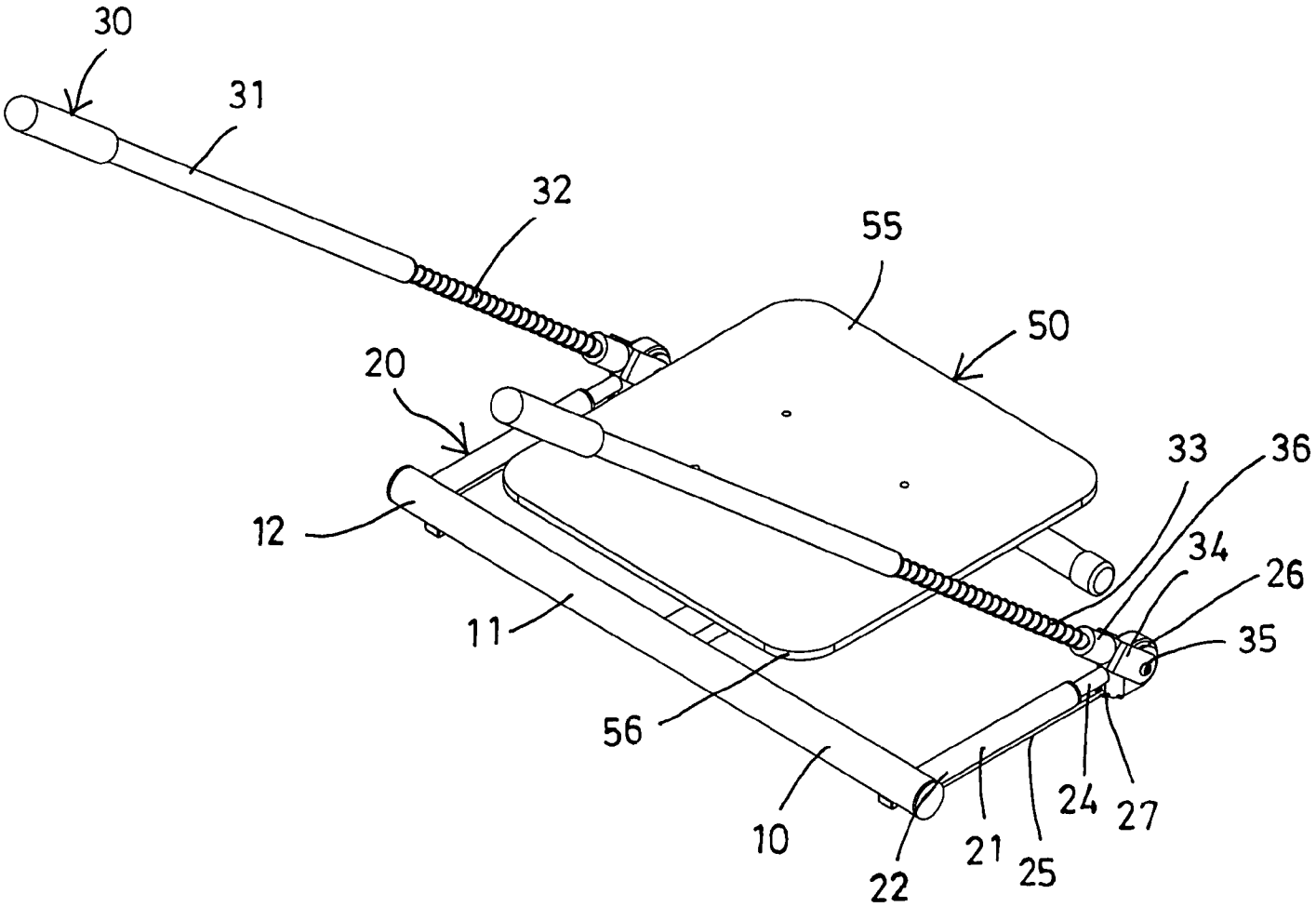
FIG. 1 is a perspective view of a skiing simulating and rehabilitation exercise machine in accordance with the present invention.
Figure 2:
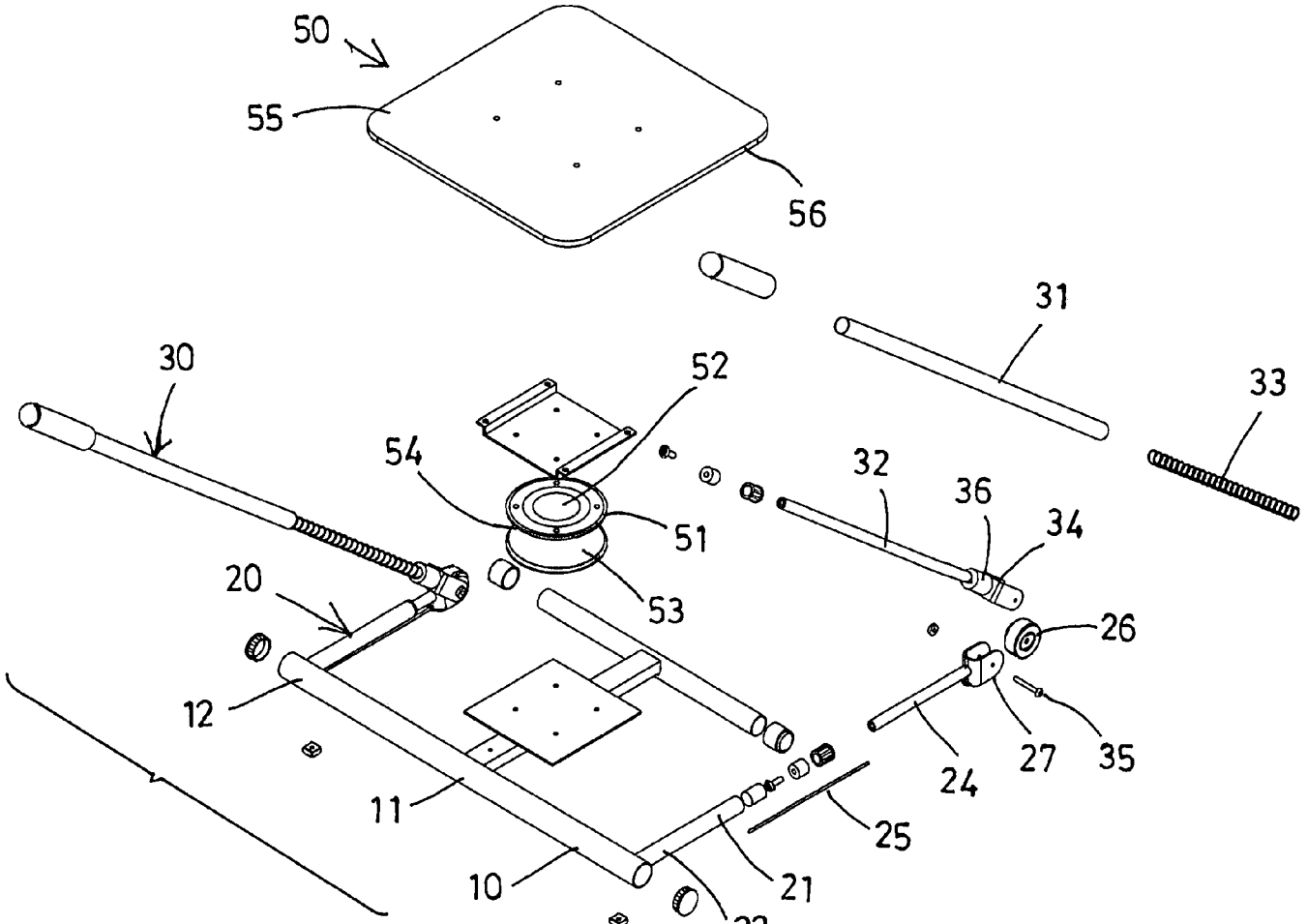
FIG. 2 is a partial exploded view of the skiing simulating and rehabilitation exercise machine.
Figure 3:
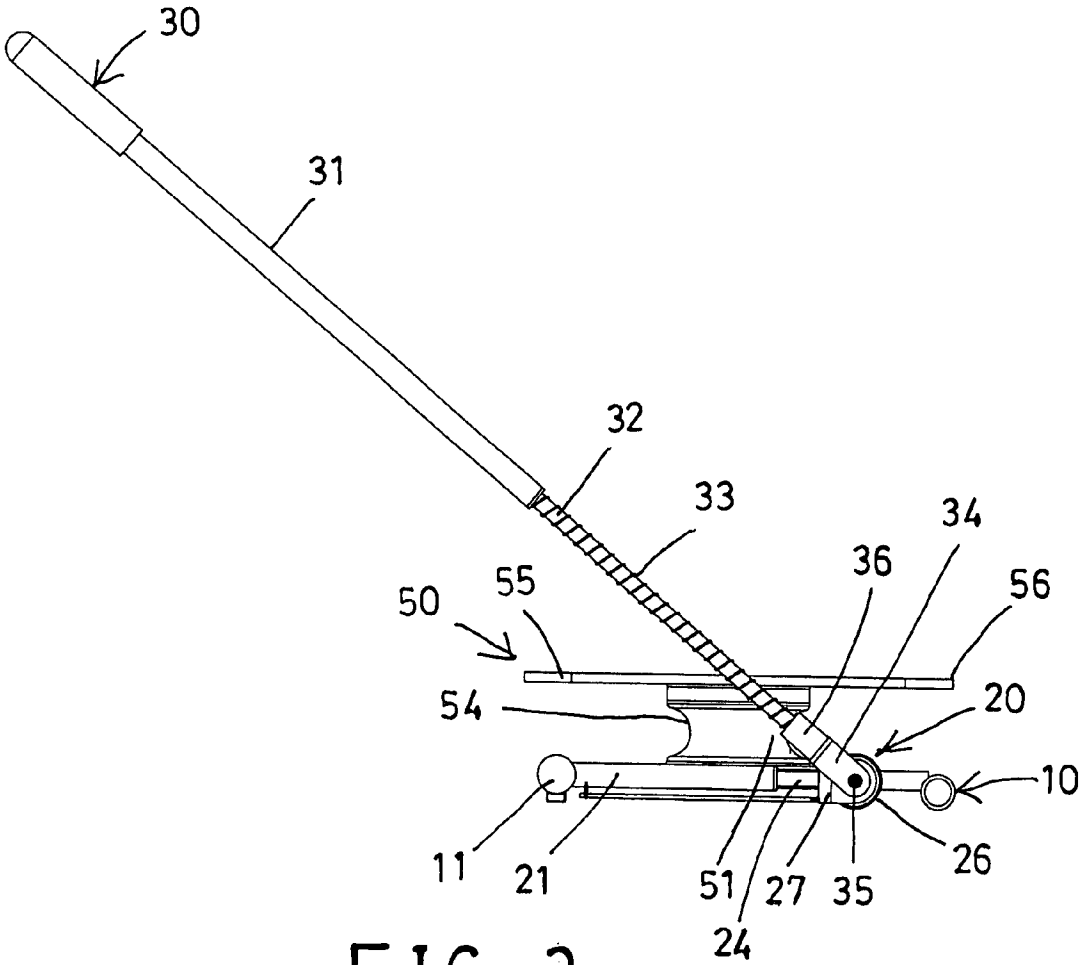
FIG. 3 is a side plan schematic view of the skiing simulating and rehabilitation exercise machine.
Figure 4:
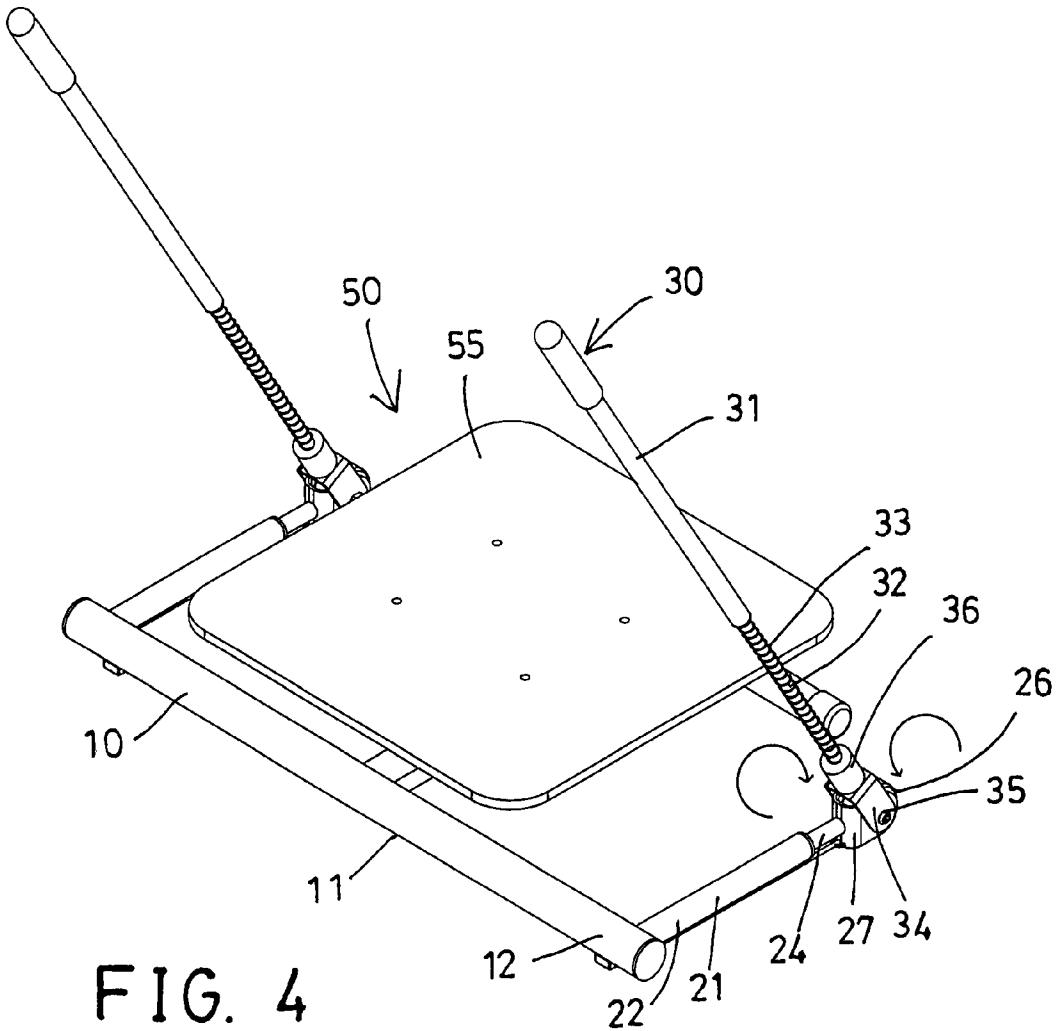
FIGS. 4, 5, 6, 7 are perspective views similar to FIG. 1, illustrating the operation of the skiing simulating exercise machine.
Figure 7:
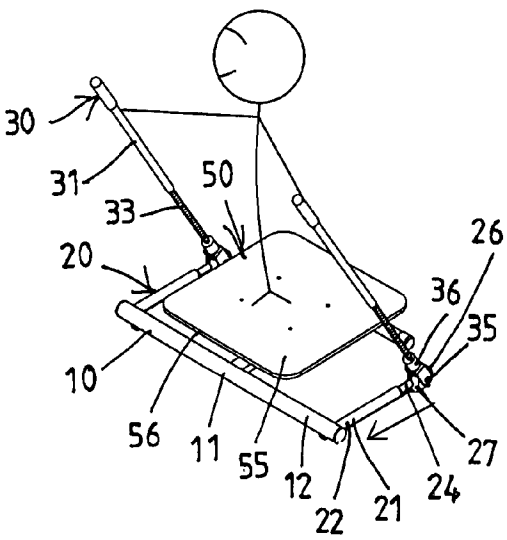
Figure 6:
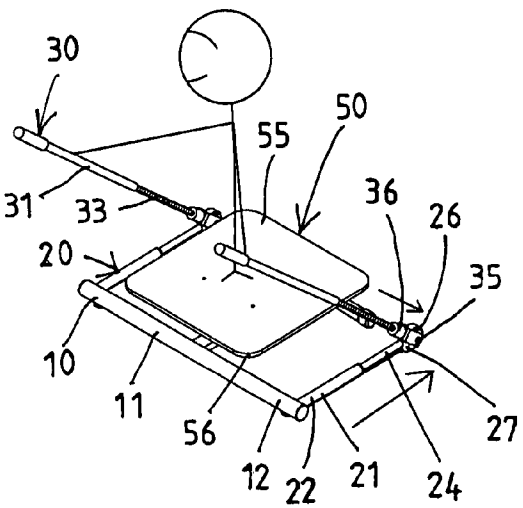
Figure 5:
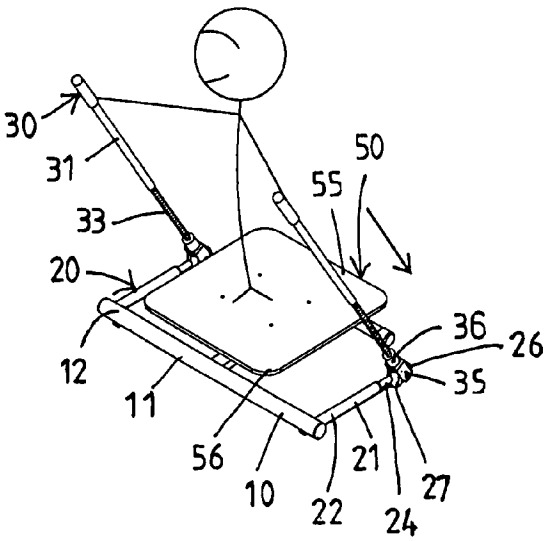
Figure 9:
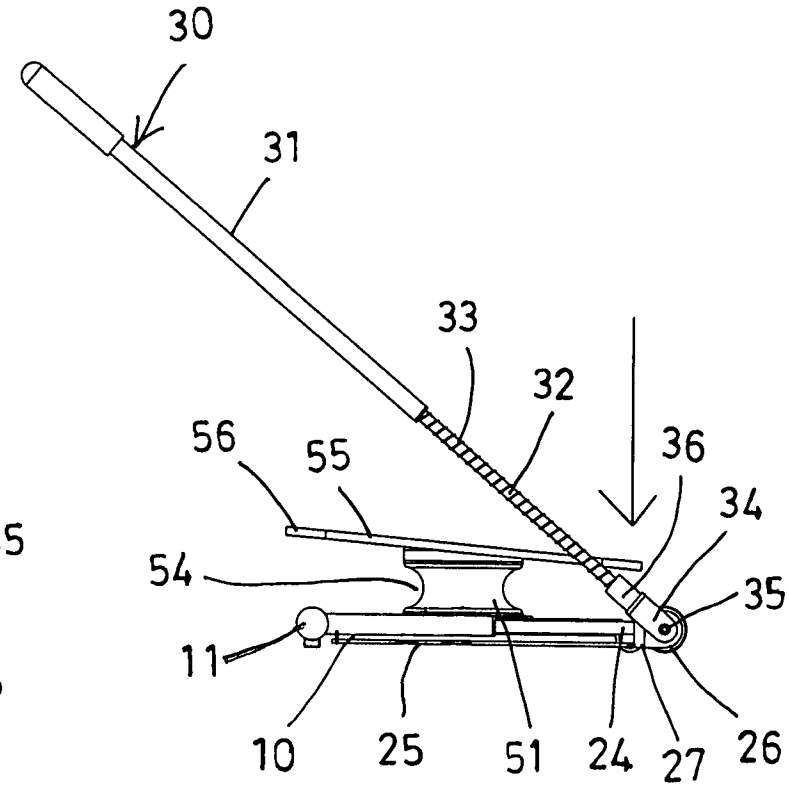
FIGS. 8, 9 are side plan schematic views similar to FIG. 3, illustrating the operation of the skiing simulating exercise machine.
Figure 8:
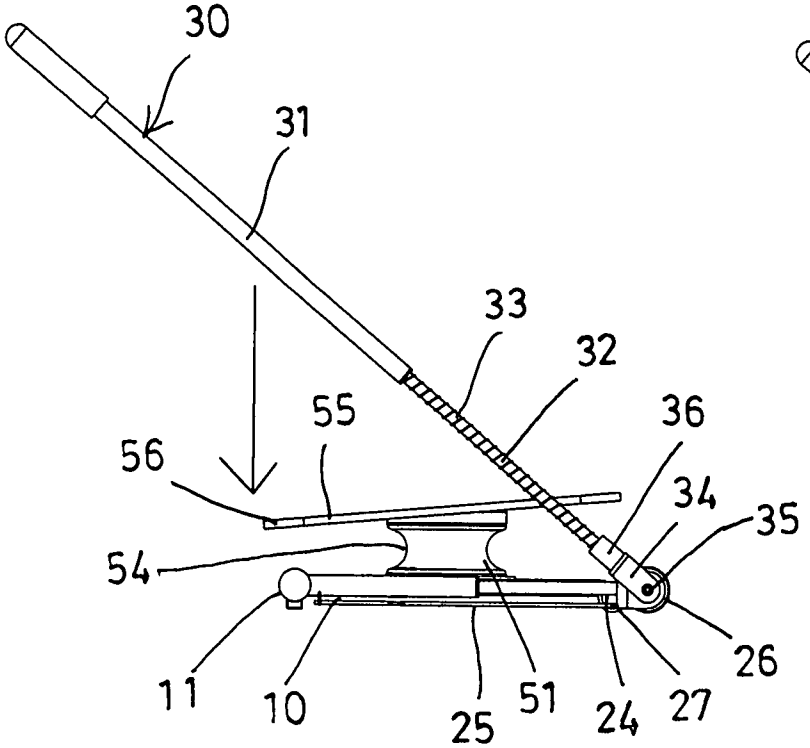
Figure 11:
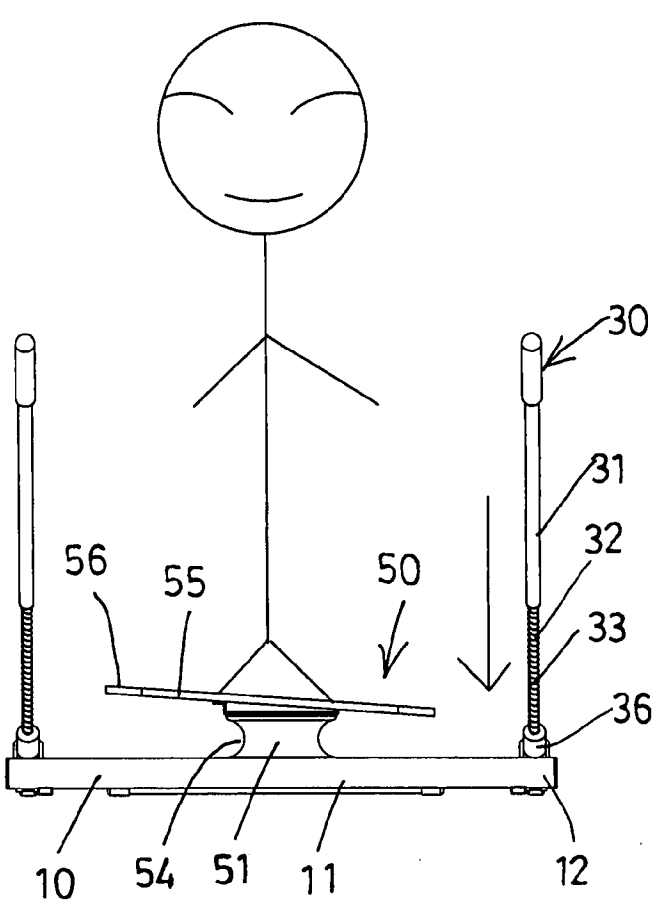
FIGS. 10, 11 are front plan schematic views illustrating the operation of the skiing simulating exercise machine.
Figure 10:
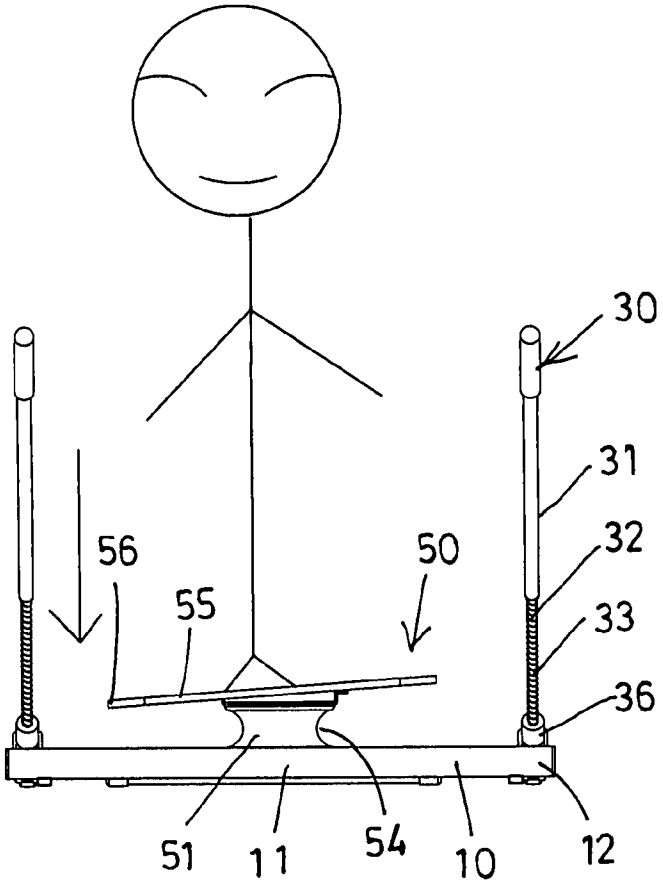

Referring to the drawings, and initially to FIGS. 1-3, a skiing simulating and rehabilitation exercise machine in accordance with the present invention comprises a lower supporting base 10 for being stably supported on the ground or the other supporting surfaces, the supporting base 10 includes a beam 11 disposed or attached or mounted or secured thereto or extended therefrom, for example, and the beam 11 includes two end portions 12. The supporting base 10 may further include a foot support 50 disposed or attached or mounted or secured thereon for supporting the user 8 thereon (FIGS. 5-7 and 10-11).

A pair of couplers 20 each include a retractable or telescopic structure and each include a tubular member or outer housing 21 having one end portion 22 pivotally or rotatably attached or mounted or secured or coupled to the respective end portion 12 of the beam 11, and the housings 21 each include a hollow structure for slidably receiving or engaging with a rod 24 and for allowing the rod 24 to be selectively moved into and out of the housings 21 (FIG. 6), and a spring biasing member 25, such as a coil spring or resilient cord or cable 25 may further be provided and engaged with or coupled between the rod 24 and the housings 21 or the supporting base 10 for selectively biasing or retracting the rod 24 into the housings 21 (FIGS. 1, 3-5, 7-9). It is preferable, but not necessarily that a pulley or wheel 26 is pivotally or rotatably attached or mounted or secured to an outer end portion 27 of the rod 24 for being stably engaged with or supported on the ground or the other supporting surfaces and for allowing the rod 24 to be smoothly moved into and out of the housings 21.

A pair of handle devices 30 each preferably include a retractable or telescopic structure for engaging with or for supporting the users 8 of different heights or sizes or dimensions, and each include a tubular member or hand grip 31 for being grasped or held by the hand of the user 8, and each include an extension 32 (FIG. 2) slidably received or engaged in the hand grip 31 and moveable or extendible into and out of the hand grip 31 for forming or defining the retractable or telescopic structure for the handle devices 30. Another spring biasing member 33, such as a resilient cord or cable or coil spring 33 may further be provided and engaged with or coupled between the hand grip 31 and the extension 32 for selectively biasing or moving the hand grip 31 out of the extension 32 and arranged for allowing the hand grip 31 to be forced or compressed or moved toward or onto the extension 32 (FIGS. 5-6) and to compress the spring biasing member 33 by the user 8.

Figure 12:
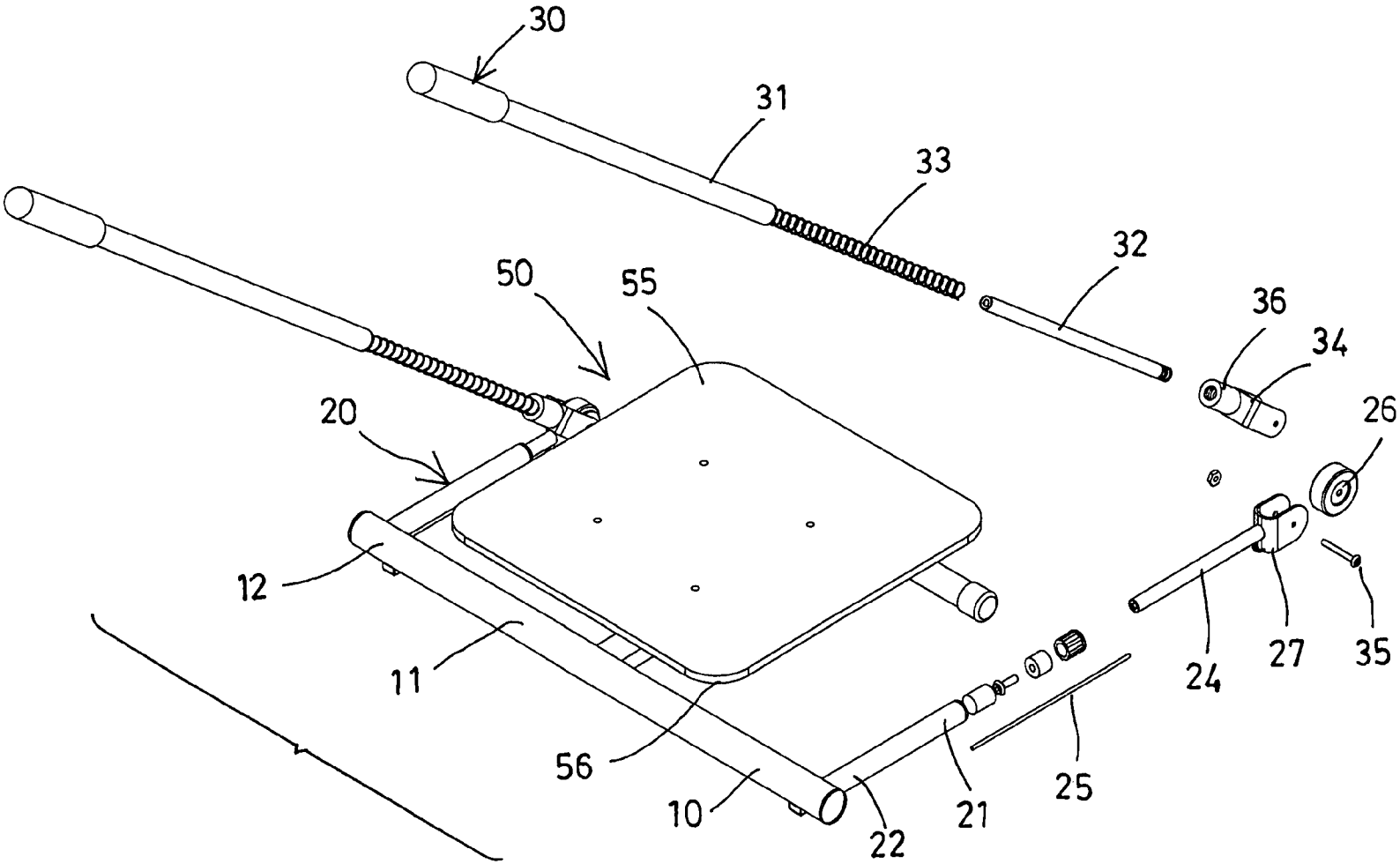
FIG. 12 is an exploded view of the skiing exercise machine.

The extension 32 includes a coupling bracket or an outer or free end portion 34 rotatably or pivotally attached or mounted or secured to the outer end portion 27 of the rod 24 with a pivot axle 35 for allowing the hand grip 31 to be rotated or pivoted or moved relative to the couplers 20 or the supporting base 10. The wheel 26 may also be rotatably or pivotally attached or mounted or secured to the outer end portion 27 of the rod 24 with the pivot axle 35. For example, the outer or free end portion 34 of the extension 32 may be selected and formed as an end piece or coupling bracket that is separated from the extension 32 (FIG. 12), and the handle device 30 may further include a coupler or socket or adapter 36 attached or mounted or secured to the end piece or coupling bracket or the outer or free end portion 34 of the extension 32 for plugging or engaging with or detachably securing to the extension 32 with a threading engagement 37, for example, or the other rods or sticks or poles (not shown) or the like that may be selectively plugged or engaged with and secured to the adapter 36, such that the extension 32 or the other rods or sticks or poles or the like may be used as the handle device 30 to operate the couplers 20.

In operation, as shown in FIGS. 4-7, the user 8 may grasp or hold the hand grips 31 of the handle devices 30 and may force and move the hand grips 31 toward or onto the extension 32 (FIGS. 5-6) and to compress the spring biasing members 33, and the user 8 may also rotate or pivot the hand grips 31 of the handle devices 30 relative to the couplers 20 or the supporting base 10 (FIG. 4), in addition, the rod 24 may also be selectively moved into and out of the housings 21 and may also be selectively moved or biased or retracted into the housings 21 with the spring biasing member 25 (FIG. 6), such that the user 8 may suitably simulate the skiing operations or exercises and such that the skiing simulating and rehabilitation exercise machine is good for rehabilitation operations or exercises.

As shown in FIGS. 2-3 and 8-9, the foot support 50 includes a soft or resilient or cushioning rubber member 51 disposed or attached or mounted or secured onto the supporting base 10 with latches, fasteners (not shown) or the like. The cushioning member 51 includes a chamber 52, such as a cylindrical chamber 52 formed therein (FIG. 2) for forming or defining a peripheral or cylindrical or tubular element 53 and for increasing the softness or the resilience of the cushioning member 51 and for allowing the cushioning member 51 to be suitably deformed or twisted or squeezed or depressed or compressed. It is preferable that the cushioning member 51 further includes an outer peripheral groove or depression or recess 54 formed therein for further increasing the softness or the resilience of the cushioning member 51 and for allowing the cushioning member 51 further to be suitably deformed or twisted or squeezed or depressed or compressed.

The foot support 50 further includes a foot support or platform 55 disposed or attached or mounted or secured onto the cushioning member 51 with latches, fasteners (not shown) or the like for supporting the user 8 thereon, in which the platform 55 includes a size or area or dimension greater than that of the cushioning member 51 for allowing the outer peripheral portion 56 of the platform 55 to be located or extended out of the cushioning member 51 and for allowing the outer peripheral portion 56 of the platform 55 to be easily depressed or compressed by the user 8, in addition, the cushioning member 51 itself that is made of soft or resilient or cushioning or rubber materials may also be deformed or twisted or squeezed or depressed or compressed for allowing the user 8 to suitably or actually simulate the skiing operations or exercises (FIGS. 5-11).

In operation, as shown in FIGS. 5-11, the user 8 may grasp or hold the handle 20, and may squeeze or depress or compress the cushioning member 51, and may also twist or squeeze or depress or compress or deform the cushioning member 51 with the platform 55 in order to suitably simulate the skiing operations or exercises. It is to be noted that the user 8 may step the central portion and/or the outer peripheral portion 56 of the platform 55 to suitably simulate the skiing operations or exercises, and the user 8 is not required to be moved away from the platform 55 such that the skiing simulating and rehabilitation exercise machine is also good for rehabilitation operations or exercises. In addition, the hand grips 31 of the handle devices 30 may also be moved as in the skiing operations or exercises.

In addition, the skiing simulating and rehabilitation exercise machine includes an improved structure that may be easily and quickly manufactured and assembled by the workers and that may be manufactured and assembled with the manufacturing procedures and the manufacturing cost. It is to be noted that the handle devices 30 may be actuated or operated individually or independently or freely by the user.

Accordingly, the skiing simulating and rehabilitation exercise machine in accordance with the present invention may be used for suitably simulating the skiing operations or exercises and for reducing the manufacturing procedures and the manufacturing cost for the skiing simulating and rehabilitation exercise machine.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A skiing simulating exercise machine comprising:
a supporting base,
a cushioning member disposed on said supporting base,
a platform mounted on the cushioning member for supporting a user thereon,
a pair of retractable couplers attached to said supporting base, and
a pair of handle devices coupled to said retractable couplers for being grasped by the user and for simulating a skiing operation.

2. The skiing simulating exercise machine as claimed in claim 1, wherein said supporting base includes a beam for attaching said retractable couplers.

3. The skiing simulating exercise machine as claimed in claim 1, wherein said retractable couplers each include an outer housing, and a rod slidably received and engaged in said housing.

4. The skiing simulating exercise machine as claimed in claim 3, wherein said retractable couplers each include a spring biasing member coupled between said rod and said housing for selectively retracting said rod into said housing.

5. A skiing simulating exercise machine comprising:
a supporting base,
a pair of retractable couplers attached to said supporting base, said retractable couplers each including an outer housing, and a rod slidably received and engaged in said housing, and said retractable couplers each including a wheel attached to said rod for allowing said rod to be smoothly moved into and out of said housing, and
a pair of handle devices coupled to said retractable couplers for being grasped by the user and for simulating a skiing operation.

6. A skiing simulating exercise machine comprising:
a supporting base,
a pair of retractable couplers attached to said supporting base, said retractable couplers each including an outer housing, and a rod slidably received and engaged in said housing, and
a pair of handle devices coupled to said retractable couplers for being grasped by the user and for simulating a skiing operation, and said handle devices each including an extension pivotally coupled to said rod with a pivot axle, and a hand grip slidably attached onto said extension.

7. The skiing simulating exercise machine as claimed in claim 6, wherein said handle devices each include a spring biasing member coupled between said hand grip and said extension for selectively biasing said extension out of said hand grip.

8. The skiing simulating exercise machine as claimed in claim 1 further comprising a foot support disposed on said supporting base for supporting a user thereon.

9. The skiing simulating exercise machine as claimed in claim 1, wherein said cushioning member includes a chamber formed therein for forming a tubular element and for increasing a resilience of said cushioning member.

10. The skiing simulating exercise machine as claimed in claim 1, wherein said cushioning member includes an outer peripheral recess formed therein for increasing a resilience of said cushioning member.

11. A skiing simulating exercise machine comprising:
a supporting base,
a pair of couplers attached to said supporting base, and
a pair of retractable handle devices coupled to said couplers for being grasped by the user and for simulating a skiing operation, said retractable handle devices each including an extension pivotally coupled to said coupler, and a hand grip slidably attached onto said extension.

12. The skiing simulating exercise machine as claimed in claim 11, wherein said handle devices each include a spring biasing member coupled between said hand grip and said extension for selectively biasing said extension out of said hand grip.

13. The skiing simulating exercise machine as claimed in claim 11, wherein said couplers each include an outer housing, and a rod slidably received and engaged in said housing.

14. The skiing simulating exercise machine as claimed in claim 13, wherein said couplers each include a spring biasing member coupled between said rod and said housing for selectively retracting said rod into said housing.

15. A skiing simulating exercise machine comprising:
a supporting base,
a pair of couplers attached to said supporting base, said couplers each including an outer housing, and a rod slidably received and engaged in said housing, said couplers each including a wheel attached to said rod, and
a pair of retractable handle devices coupled to said couplers for being grasped by the user and for simulating a skiing operation.

16. The skiing simulating exercise machine as claimed in claim 11 further comprising a foot support disposed on said supporting base for supporting a user thereon.

17. The skiing simulating exercise machine as claimed in claim 16, wherein said foot support includes a cushioning member disposed on said supporting base, and a platform mounted on the cushioning member for supporting the user thereon.

18. A skiing simulating exercise machine comprising:
a supporting base,
a foot support disposed on said supporting base for supporting a user thereon, said foot support including a cushioning member disposed on said supporting base, a platform mounted on the cushioning member for supporting the user thereon, said cushioning member including a chamber formed therein for forming a tubular element and for increasing a resilience of said cushioning member, a pair of couplers attached to said supporting base, and a pair of retractable handle devices coupled to said couplers for being grasped by the user and for simulating a skiing operation.

* * * * *